United States Patent [19]

Galloway et al.

[11] Patent Number: 4,526,346

[45] Date of Patent: Jul. 2, 1985

[54] SELF-CONTAINED ELEVATING TABLE

[75] Inventors: James J. Galloway, Palos Verdes Estates; Albert E. Blanchard, Temple City, both of Calif.

[73] Assignee: G. W. Galloway Company, Inc., Baldwin Park, Calif.

[21] Appl. No.: 339,869

[22] Filed: Jan. 18, 1982

[51] Int. Cl.[3] ..... B66F 3/22

[52] U.S. Cl. ..... 254/122; 182/63; 182/148; 187/18

[58] Field of Search ..... 254/122, 9 R, 9 B, 9 C; 182/63, 144, 148; 187/18, 8.71, 8.72; 14/45

[56] References Cited

U.S. PATENT DOCUMENTS

| | | | |
|---|---|---|---|
| 2,862,689 | 12/1958 | Dalrymple et al. | 187/18 X |
| 2,922,533 | 1/1960 | Barge, Jr. | 187/8.72 |
| 2,928,558 | 3/1960 | Bamford | 187/8.72 X |
| 2,937,852 | 5/1960 | Clarke | 254/122 |
| 3,404,791 | 10/1968 | Larson | 254/122 X |
| 3,991,857 | 11/1976 | Wolk et al. | 254/122 X |
| 4,114,854 | 9/1978 | Clark | 254/122 |

*Primary Examiner*—Frederick R. Schmidt
*Assistant Examiner*—Steven P. Schad
*Attorney, Agent, or Firm*—Sellers and Brace

[57] ABSTRACT

An improved self contained elevating table suitable for loading dock and the like load lifting operations. The platform is supported by at least one pair of scissor legs the opening of which is accelerated and amplified by a cylinder-operated toggle lever subassembly the opposite ends of which are pivotally connected between the outer end portion of one leg and a bracket mounted for movement with the other leg at a point spaced radially from the common midlength pivot access of the pair of legs. The roller-equipped pivot interconnecting the toggle lever and cylinder is offset from a line through the remotely positioned pivot axis of the cylinder and toggle subassembly, and this roller cooperates with a ramp or other constraint on the apparatus to accelerate and amplify initial opening of the scissor legs from the collapsed horizontal positions thereof.

10 Claims, 5 Drawing Figures

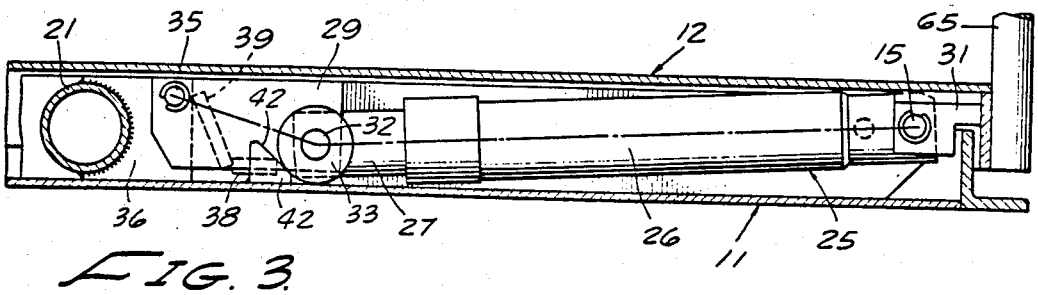
FIG. 3.
FIG. 4.
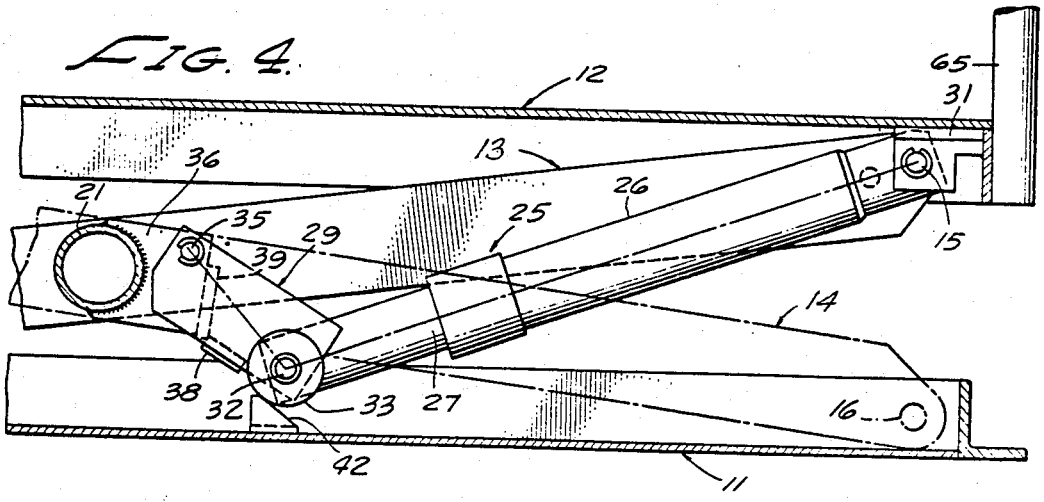
FIG. 5.
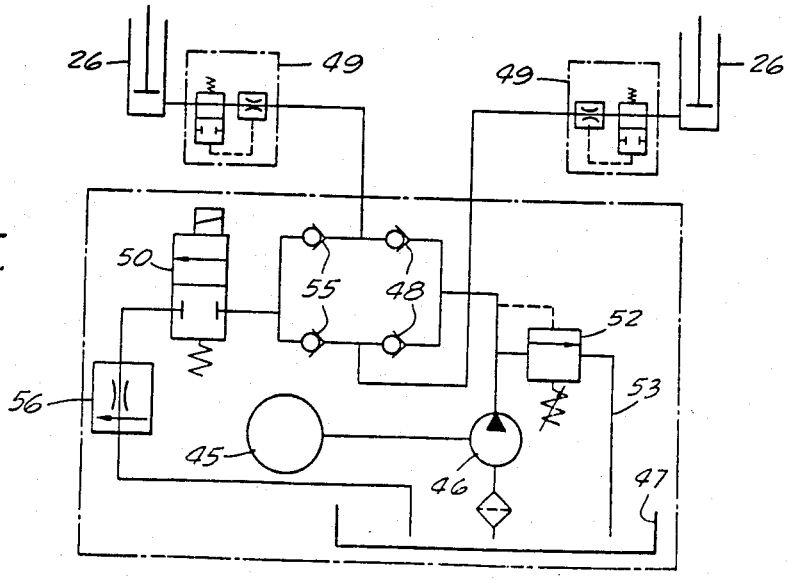

SELF-CONTAINED ELEVATING TABLE

This invention relates to elevating tables, and more particularly to an improved and simplified table assembly having simplified power operated toggle linkage means for accelerating and amplifying the opening movement of the table from a fully collapsed condition.

BACKGROUND OF THE INVENTION

Elevating tables are commonly employed in transferring lading between relatively closely spaced different levels as exemplified, for example, in transferring loads between ground level and the deck of transport vehicles and in loading dock operations generally. In such operations it is highly important that the platform be retractable as close as possible to the lower level despite the necessary presence of underlying power means for raising and lowering the platform. One or more pairs of scissors legs commonly interconnect the platform and a supporting base. These legs and the power operating means therefore require a certain amount of critical space. Heretofore, many proposals have been made in efforts to minimise this critical spacing. Attempts have been made to place the operating cylinder alongside one of the scissor legs with one end pivotally supported near the outer end of that leg and the other end connected to the midlength area of the other leg via a short strut. However, such attempts involve severe high stress problems if the platform is lowered close to the floor because the three pivot axes of the power unit are then very close to a common plane. Typical of these proposals are disclosed by U.S. Pat. Nos. to Dalrymple et al. 2,862,689; Bamford et al. 2,928,558; Clarke 2,937,852; Dale 3,032,319; Larson 3,246,876; and Wolk et al. 3,991,857.

Each of these and other less relevant prior proposals are subject to numerous disadvantages and shortcomings. Only Larson and Wolk et al recognise the desirability of interconnecting the midlengths of the pairs of scissor legs with strong torsion transmitting members to aid in maintaining the platform level under widely varying loading conditions. However, each of these prior teachings is lacking in other respects. Thus Larson lacks power operating means permitting full collapse of the load platform as well as any means for accelerating and amplifying opening of the platform from its fully collapsed position. Wolk et al does appear to provide for full collapse but does so at the expense of an objectionably costly multipart operating mechanism utilizing complex and costly camming means insertable between the two legs of each pair in an area closely adjacent the scissor pivot axis. The remaining prior proposals identified above rely upon structures and operating principles differing widely from one another and from those characterizing this invention and are subject to serious other obvious disadvantages.

SUMMARY OF THE INVENTION

The aforementioned and other shortcomings and disadvantages of prior constructions are avoided by this invention in the form of an extremely simply self-contained rugged assembly having a minimum of components so designed that the load platform and its operating structure are collapsible to a minimum height above the floor, yet is readily extendable at an accelerated and amplified rate from this fully collapsed condition. These objectives are achieved by an extremely simple cylinder and toggle lever subassembly having one end pivotally supported adjacent the outer end of one leg and the remote end of the toggle lever having a limited pivotal connection to the other leg at a point radially spaced from the scissor leg pivot axis. The middle pivot of this three pivot operating assembly is always vertically offset from a line through the remotely spaced pivots and is provided with one or more rollers cooperable with an inclined ramp effective to impart powerful upward forces to the platform via these remotely spaced pivots and thereby accelerate and amplify the opening movement of the scissor legs from their horizontal collapsed position. Once this initial opening cycle is completed the toggle lever abuts a stop whereupon the cylinder has maximum effectiveness in continuing the elevating cycle.

The inner legs of each pair of scissor legs is rigidly interconnected by a torsion tube whereas the outer legs are rigidly interconnected by a torsion or torque tube or shaft journalled within the first mentioned tube. As will be evident, the end of the power linkage connected to or adjacent the outer end of one leg is highly effective in elevating that leg while the toggle lever at the other end of the cylinder is highly effective through its now rigid connection with the torsion tube and the midlength of the other leg to pivot that leg upwardly in unison with the elevation of the first mentioned leg.

Accordingly, it is a primary object of this invention to provide an improved extremely rugged self-contained elevating table embodying structural and functional improvements over prior elevating tables.

Another object of the invention is the provision of a self-contained elevating table having at least one pair of scissor legs interconnecting the base and load platform and having novel and improved power means for raising the load platform from a fully collapsed position with the scissor legs parallel to one another.

Another object of the invention is to provide a simplified power operating means for a pair of scissor legs employing a toggle lever and power cylinder pivotally connected in series between the outer end of one leg and a pivot connection mounted for movement with the other leg at a point spaced radially from the midlength axis of the scissor legs.

Another object of the invention is the provision of an elevating table supported by a pair of scissor legs having a toggle lever and cylinder operating subassembly interconnecting the legs and cooperating with a ramp having an inclined surface effective to accelerate and amplify elevation of the platform from a fully collapsed position.

These and other more specific objects will appear upon reading the following specification and claims and upon considering in connection therewith the attached drawing to which they relate.

Referring now to the drawing in which a preferred embodiment of the invention is illustrated:

FIG. 3 is a fragmentary cross sectional view on an enlarged scale taken along the right hand end of FIG. 1 and showing the load platform fully collapsed;

FIG. 4 is a view similar to FIG. 3 but showing the load platform partially elevated above the base; and FIG. 5 is a schematic diagram of the hydraulic system.

Figure 2:
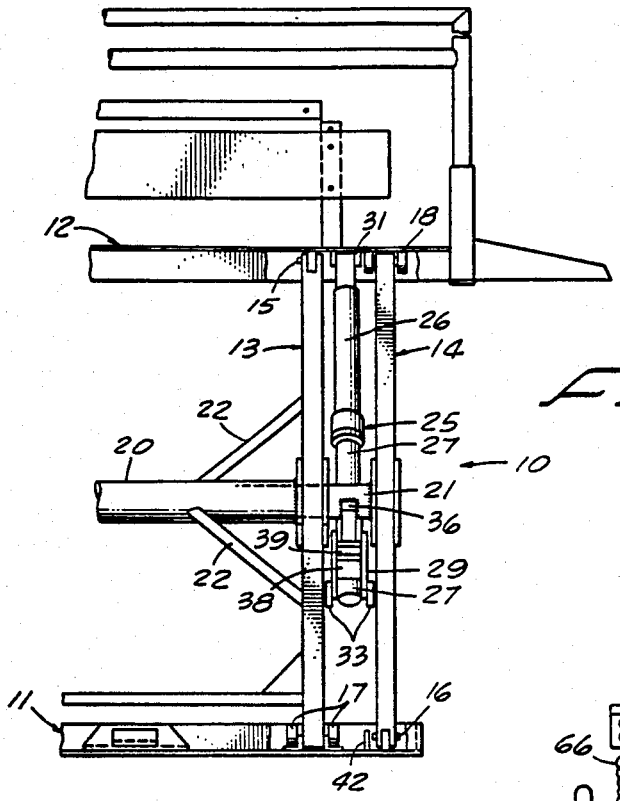
FIG. 2 is an end elevational view of one side only of the table taken along line 2—2 on FIG. 1.
Figure 1:
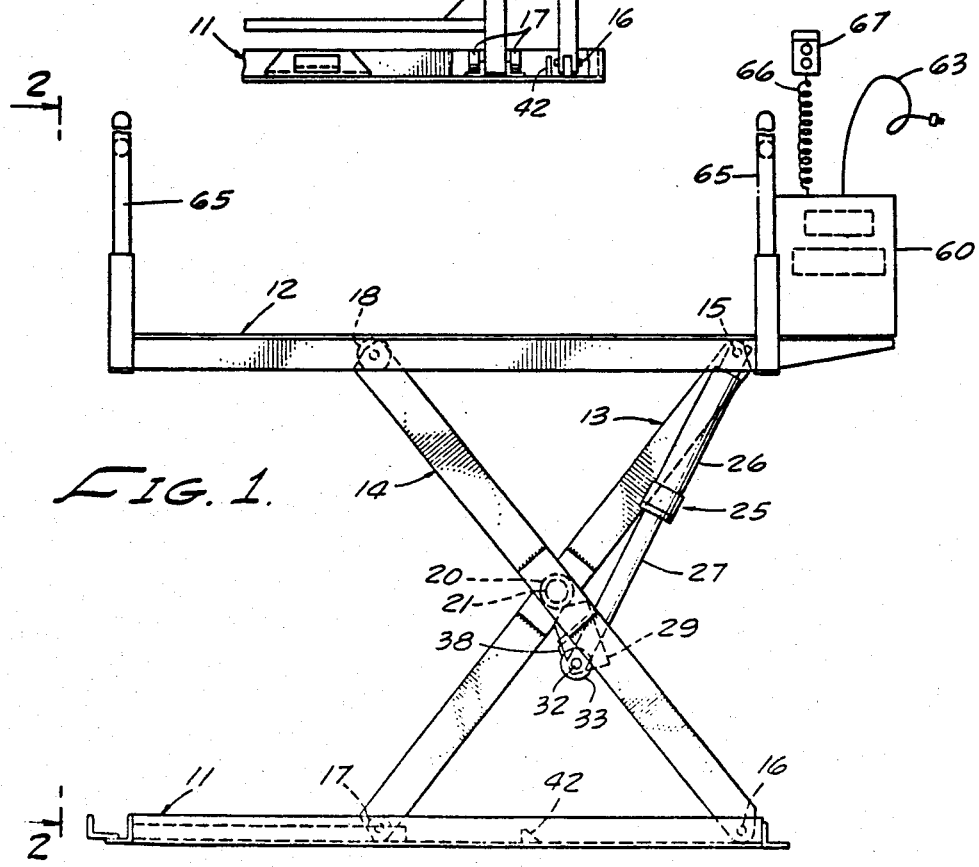
FIG. 1 is a side elevational view of an illustrative embodiment of the invention elevating table.

Referring initially more particularly to FIGS. 1 and 2, there is shown one preferred embodiment of the invention elevating table designated generally 10. This table has as principal components a shallow upturned cupshaped base 11 and a shallow inverted cupshaped platform 12 operatively interconnected along their opposite lateral sides by a respective set of inner and outer scissor legs 13 and 14. The inner leg of each pair is connected to the rear end of platform 12 by a pivot pin 15 and the outer leg 14 is connected to the rear end of base 11 by pivot pin 16. The opposite ends of legs 13 and 14 are equipped with rollers 17 and 18 which roll along the base and the platform respectively as the legs open and close in a manner well known to those skilled in this art. The midlengths of inner legs 13 are rigidly interconnected by a torsion tube 20 and outer legs 14 are likewise interconnected by a torsion tube or shaft 21 journalled within member 20. Preferably, the inner legs are additionally braced and reinforced by struts 22 positioned as shown in FIG. 2.

The inner and outer legs of each scissor pair are laterally spaced apart to accommodate a power operated toggle linkage designated generally 25. One arm of this linkage comprises the cylinder 26 and its piston rod 27 and the other arm comprises a relatively short toggle lever 29. As is best shown in FIG. 2, the outer end of cylinder 26 is pivoted to platform 12 by a clevis 31 secured to the bottom of the platform. However, it will be understood that cylinder 26 could be pivotally supported on the adjacent end of scissor leg 14 and even on the pivot pin 15 for this leg.

The outer end of piston rod 27 is connected by pivot pin 32 to the lower corner of toggle lever 29. The outer ends of pivot pin 32 also support a pair of rollers 33. The upper or diagonally opposite end corner of toggle lever 29 is pivoted by pin 35 to a bracket 36 welded to torsion shaft or tube 21. Preferably, toggle lever 29 comprises a pair or parallel plates straddling bracket 36 and rigidly interconnected to one another by a pair of cross bars 38 and 39 welded thereto. Crossbar 39 is positioned to abut the outer end of bracket 36 which provides a stop to limit the clockwise rotation of toggle lever 29 as viewed in FIGS. 3 and 4. FIG. 3 shows stop bar 39 inclined downwardly and to the right away from the end of bracket 36 when the scissor legs are fully collapsed whereas FIG. 4 shows the toggle lever rotated downwardly about pivot pin 35 with stop bar 39 in abutment with the end of bracket 36, as it is after the platform 12 has been elevated a predetermined distance.

To further aid and accelerate the initial opening movement of the fully collapsed platform there is preferably provided short inclined ramps suitably rigidly secured, as by welding, to base 11. These ramps are positioned in the path of advance of rollers 33 mounted on the pivot pin 32 connecting lever 29 to the piston rod 27. It will therefore be recognised that the extension of the piston rod 27 causes rollers 33 to ride upwardly along ramps or constraint means 42 while simultaneously rotating toggle lever 29 clockwise until arrested by the engagement of its stop 39 against the end of bracket 36. The combination of these camming and toggle opening operations cooperate in accelerating and amplifying the upward movement of the platform from its fully collapsed condition. The amount of this acceleration and the amount of force is dependent on the shape of the ramp. In this connection, it will be recognized that the slightest advance of the rollers 33 along ramps 42 is highly effective in elevating each of the pivot pins 15 and 35 at the opposite ends of the toggle linkage 25 despite the fact that, initially, pins 15, 32 and 35 are nearly in the same plane.

Referring now to FIG. 5, there is shown a preferred hydraulic circuit for cylinders 26. This circuit includes a motor 45 driving a pump 46 to pump fluid from tank 47 to the two cylinders 26 via separate check valves and conventional and well known identical velocity fuses 49, 49. During the elevating cycle of the table the pressurized fluid is prevented from returning to the reservoir by the now closed solenoid control valve 50. During the elevating cycle if the fluid pressure exceeds a predetermined level the normally closed pressure relief valve 52 opens and releases the fluid back to the reservoir via return pipe 53. To lower the platform, it is unnecessary to operate pump 46 it merely being necessary to operate the control housing 67 to energize the solenoid-controlled valve 50 to its open position whereupon fluid from the cylinders flows backwardly through velocity fuses 49, past check valves 55, and through the open solenoid valve 50 and the flow metering valve 56 to the reservoir at a suitable safe rate. The platform continues to lower until both sets of scissor legs 13 and 14 reach a parallel position concealed within the confines of base 11 and platform 12 as is shown in FIG. 3.

The hydraulic components are located within a housing 60 (FIG. 1) mounted on the shelf 61 along one side of platform 12. The elevating table is fully self-contained and merely requires that the service cord 63 be connected to a power outlet. The electrical controls include control buttons mounted in a housing 67 connected by a cord 66 to the hydraulic components.

As herein shown, the platform is equipped with only a single pair of guard railings 65 crosswise of its opposite ends but it will be understood that it may be provided with an additional railing or railings along the sides which are readily removable or hinged to swing to open positions.

The operation of the power driven toggle linkage 25 will be quite evident from a consideration of FIGS. 3 and 4. It will be noted from FIG. 3 that the toggle knuckle joint represented by pivot pin 32 has its axis located below a line through the axes of pin 35 and the pivot connection of the cylinder to the platform. Accordingly, as pressurized fluid is supplied to the right hand end of cylinder 26 its piston starts to extend to the left. This action exerts a force through the outer end of the piston tending to force the platform upwardly. Simultaneously, the extension of the piston causes rollers 33 to ride upwardly along ramp 42 while at the same time forcing toggle lever 29 to pivot clockwise about the axis of pin 35. The upward force applied to the platform at the outer end of leg 14 together with the elevating forces applied to the midlength of the scissor legs by the clockwise rotation of toggle lever 29 and by roller 33 and ramp 42 cooperate in accelerating and amplifying the upward opening of the platform. When stop 39 of the toggle levers comes into abutment with brackets 36, further extension of the cylinder piston operates to apply rotary movement to torsion member 20 as platform 12 and the outer ends of the cylinders apply an upward force to the outer ends of legs 13.

It will therefore be recognized that the platform is maintained in a highly stabilized parallel relationship with the base during both opening and closing cycles. The very strong torsion members 20 and 21 rigidly interconnecting the midlength portions of the two pairs of scissor legs also contribute importantly in maintaining the form level and parallel to the base at all times and even under unequal load distribution conditions.

While the particular self-contained elevating table herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. In an elevating table of the type having a load platform and stationary base means pivotally interconnected between one pair of adjacent ends by at least one pair of first and second legs pivotally connected transversely of their midlengths and having their other ends equipped with rollers in rolling contact with said platform and with said base means, that improvement which comprises:

operating means for raising and lowering said platform located alongside said legs comprising an elongated toggle lever having one end pivotally mounted for limited unrestrained pivotal movement parallel to said first leg and about a first axis on said first leg spaced radially from the midlength pivot axis of said legs, stop means on said first leg positioned to limit the pivotal movement of said toggle lever as said platform is opened to a predetermined level above said base means, the opposite end of said toggle lever being equipped with a roller connected to and rotatable about a second axis on the adjacent end of piston and cylinder means, the opposite end of said piston and cylinder means being pivotally supported adjacent the outer end of said second leg for pivotal movement about a third axis parallel to said first and second axes, and said second axis being displaced vertically below a line through said first and third axes when said legs are collapsed to lie substantially horisontally with said piston retracted into said cylinder means;

ramp means secured to said stationary base means having a camming surface inclined to the horizontal positioned in the path of said roller on the adjacent end of said piston and cylinder means and cooperating solely therewith as said piston begins to extend from the retracted position thereof to initiate the pivoting of said toggle lever toward said stop means and accelerate the elevation of said platform from the fully collapsed position thereof; and means for supplying pressurized fluid to said piston and cylinder means to extend said piston and initiate pivotal movement of said toggle lever toward said stop means and move the roller-equipped end of said piston and cylinder means along said ramp means.

2. In an elevating table as defined in claim 1 characterized in that said toggle lever and said piston and cylinder means are confined substantially to a vertical space lying between the opposite lateral edges of said first and second legs when said legs are collapsed to lie substantially horizontally.

3. An elevating table as defined in claim 1 characterized in the provision of two pairs of said first and second legs, inner and outer concentric torsion means extending between said pairs of legs, said inner torsion means having its opposite ends fixed to the outermost legs of each pair and the outer torsion means having its opposite ends fixed to the innermost legs of each pair.

4. An elevating table as defined in claim 3 characterized in the provision of substantially duplicate operating means operatively associated with a respective pair of said legs and operable in unison to control the position of said platform relative to said base means.

5. An elevating table as defined in claim 3 characterized in that said base means and said platform comprise shallow cup-shaped members having their open sides facing towards one another and sized to telescope partially within one another in the collapsed position of said legs.

6. An elevating table as defined in claim 1 characterized in that said first end of said toggle lever is pivotally connected to the outer end of a bracket projecting radially from said inner torsion means in an area between said first and second legs.

7. An elevating table as defined in claim 1 characterized in the provision of control means for said means supplying pressurized fluid to said cylinder means via separate parallel check-valve-controlled tubing means while elevating said platform and including means for exhausting fluid from said cylinder means at a metered rate via separate check-valve-controlled tubing means while lowering said platform.

8. Lifting apparatus comprising:

a stationary base member and a platform member maintained parallel to one another by two sets of spaced apart scissor linkages each including a pair of legs pivoted to one another at their midlengths on a common axis, one pair of adjacent leg ends having roller means positioned to roll along said base and along said platform respectively as said legs open and close and the other ends of said legs being pivoted respectively to said base and to said platform;

power means for opening said legs from a closed position lying substantially parallel to one another, said power means including hydraulic cylinder means pivoted to a first roller-equipped end of elongated toggle lever means having its second end pivotally supported adjacent the outer end of a first one of a pair of said legs, and the midlength portion of a second one of said pair of legs being pivotally connected to the other end of said toggle lever means remote from roller-equipped end thereof;

said toggle lever means being pivotable between a first position substantially aligned with said second scissor leg and a second position against a stop mounted on said second leg whereat said toggle lever means lies at an acute angle to said second scissor leg; and ramp means immovably fixed to said stationary base member and located in the path of movement of said roller-equipped end of said toggle lever means and operable upon the initial expansion of said cylinder means from the fully retracted position thereof to pivot said toggle lever means from said first position toward said second position thereof thereby to open said pairs of scissor linkages away from one another.

9. Lifting apparatus as defined in claim 8 characterized in that the axis of said roller equipped end of said toggle lever means is offset vertically below a line between the pivots connecting the remotely spaced ends of said power means and said toggle lever means.

10. Lifting apparatus as defined in claim 8 characterized in that said ramp means responsive to the expansion of said cylinder means includes cam means effective to pivot said toggle lever means out of substantial alignment with said first scissor leg as said cylinder means starts to expand from the retracted position thereof.

* * * * *